US005798701A

United States Patent [19]

Bernal et al.

[11] Patent Number: 5,798,701

[45] Date of Patent: Aug. 25, 1998

[54] SELF-ADJUSTING SMOKE DETECTOR WITH SELF-DIAGNOSTIC CAPABILITIES

[75] Inventors: Brian A. Bernal, Charlotte, N.C.; Daniel P. Croft, Beaverton, Oreg.; Kirk R. Johnson, Rindge, N.H.; Douglas H. Marman, Ridgefield, Wash.; Mark A. Peltier, Sherwood, Oreg.

[73] Assignee: SLC Technologies, Inc., Tualatin, Oreg.

[21] Appl. No.: 807,627

[22] Filed: Feb. 27, 1997

Related U.S. Application Data

[63] Continuation of Ser. No. 297,290, Aug. 26, 1994, abandoned.

[51] Int. Cl.[6] ..... G08B 17/10

[52] U.S. Cl. ..... 340/628; 340/629; 340/630; 250/574

[58] Field of Search ..... 340/628, 629, 340/630, 587, 588, 589; 250/572, 573, 574

[56] References Cited

U.S. PATENT DOCUMENTS

| | | | |
|---|---|---|---|
| 4,222,046 | 9/1980 | Pinckaers | 340/629 |
| 4,394,655 | 7/1983 | Wynne et al. | 340/825.36 |
| 4,420,746 | 12/1983 | Malinowski | 340/630 |
| 4,470,047 | 9/1984 | Vogt et al. | 340/825.36 |
| 4,507,653 | 3/1985 | Bayer | 340/539 |
| 4,524,351 | 6/1985 | Kimura et al. | 340/629 |
| 4,672,217 | 6/1987 | Dobrzanski | 250/574 |
| 4,749,986 | 6/1988 | Otani et al. | 340/587 |
| 4,785,283 | 11/1988 | Yuchi | 340/588 |
| 4,803,469 | 2/1989 | Matsushita | 340/628 |
| 4,827,247 | 5/1989 | Giffone | 340/630 |
| 4,871,999 | 10/1989 | Tshii et al. | 340/628 |
| 5,155,468 | 10/1992 | Stanley et al. | 340/588 |
| 5,172,096 | 12/1992 | Tice et al. | 340/588 |
| 5,546,074 | 8/1996 | Bernal et al. | 340/628 |

FOREIGN PATENT DOCUMENTS 0290413 9/1988 European Pat. Off. ..... G08B 29/00

OTHER PUBLICATIONS

Apollo Fire Detectors Ltd., "The Use of Threshold Compensation With Apollo XP95 Smoke Monitors" (1994).

Cerberus Ltd., Trinity Court, Wokingham, England, "Interactive," pp. 1–2.

Edwards Systems Technology, Sarasota, Florida, "Intelligent 4D Multisensor Detector, Model SIGA–IPHS," stamped preliminary (1994).

First Inertia Switch, Grand Blanc, Michigan, "Fireray Optical Beam Smoke Detector Application & Installation Guide".

*Primary Examiner*—Jeffery A. Hofsass
*Assistant Examiner*—Ashok Mannava
*Attorney, Agent, or Firm*—Stoel Rives LLP

[57] ABSTRACT

A smoke detector (10) has internal self-adjustment and self-diagnostic capabilities. It includes a microprocessor-based alarm control circuit (24) that periodically checks the sensitivity of a smoke sensing element (20) to a smoke level in a spatial region (12). The alarm control circuit and the smoke sensor are mounted in a discrete housing (25) that operatively couples the smoke sensor to the region. The microprocessor (30) implements a routine (50) stored in memory (32) by periodically determining a floating adjustment (FLT_ADJ) that is used to adjust the output (RAW_DATA) of the smoke sensing element and of any sensor electronics (40) to produce an adjusted output (ADJ_DATA) for comparison with an alarm threshold. The floating adjustment is not greater than a maximum value (ADJISENS) or less than a minimum value (ADJSENS). Except at power-up or reset, each floating adjustment is within a predetermined slew limit of the immediately preceding floating adjustment. The floating adjustment is updated with the use of averages (NEW_AVG) of selected signal samples taken during data gathering time intervals having a data gathering duration that is long in comparison to the smoldering time of a slow fire. The adjusted output is also used for self-diagnosis.

20 Claims, 9 Drawing Sheets

SELF-ADJUSTING SMOKE DETECTOR WITH SELF-DIAGNOSTIC CAPABILITIES

RELATED APPLICATION

This is a continuation of U.S. patent application Ser. No. 08/297,290, filed Aug. 26, 1994 now abandoned.

TECHNICAL FIELD

The present invention relates to smoke detectors and, in particular, to a self-contained smoke detector that has internal self-diagnostic and self-adjustment capabilities that enable it to determine when it is out of calibration and to compensate for its increased or decreased sensitivity to smoke.

BACKGROUND OF THE INVENTION

A spot photoelectric smoke detector measures smoke conditions at a spot in a spatial region and produces an alarm signal in response to the presence of unacceptably high smoke levels. Such a system contains in a discrete housing covered by a smoke intake canopy a light-emitting device ("emitter"), e.g., an LED, and a light sensor ("sensor"), e.g., a photodiode, positioned in proximity to measure the amount of light transmitted from the emitter to the sensor by scattering from smoke particles.

Because they cooperate to measure the presence of light and determine whether it exceeds a threshold amount, the emitter and sensor need initial calibration and periodic testing to ensure that their optical response characteristics are within nominal limits specified. Older designs of spot photoelectric smoke detectors suffer from the disadvantage of requiring periodic inspection of system hardware and manual adjustment of electrical components to carry out a calibration sequence.

U.S. Pat. No. 5,546,074 of Bernal et al. for a SMOKE DETECTOR SYSTEM WITH SELF-DIAGNOSTIC CAPABILITIES AND REPLACEABLE SMOKE INTAKE CANOPY ('074 patent) assigned to Sentrol, Inc., of Tualatin, Oregon ("Sentrol"), the assignee of the instant application, and incorporated herein by reference, describes a newer design of spot smoke detector, that has a replaceable canopy and internal self-diagnostic capabilities for determining and signaling when the smoke detector is out of calibration.

The older designs and the self-diagnosing smoke detector of the '074 patent undergo a change with time in their sensitivity to smoke. A spot photoelectric smoke detector can become more sensitive to smoke as surfaces within it become contaminated with particles such as dust particles or less sensitive to smoke as the intensity of emission from the emitter diminishes with time in operation. Such changes can cause a smoke detector to indicate an alarm condition when one does not exist (over-sensitivity) or to fail to indicate an alarm condition when one does exist (under-sensitivity).

Such changes in sensitivity go undetected in the absence of inspection with the older designs; they are signaled by the smoke detector of the '074 patent. However, in all of these designs, changes in sensitivity persist until a human being intervenes. It is expensive to inspect the older designs for loss of sensitivity and to maintain them, and even replacing the canopy of a smoke detector of the '074 patent has a cost. Also, a replaceable canopy may not have the uniformity of response among different canopies that is characteristic of the canopy of the smoke detector of the '074 patent. Without such uniformity of response, replacing the canopy will change the sensitivity of older designs of smoke detectors.

SUMMARY OF THE INVENTION

An object of the invention is, therefore, to increase the time before a smoke detector becomes sufficiently over- or under-sensitive to require servicing or replacement.

Another object of the invention is to increase the time between replacements of a canopy in a smoke detector that is capable of performing self-diagnostic functions to determine whether it is in its calibration limits.

A further object of the invention is to provide a smoke detector that adjusts itself for gain or loss of sensitivity after it is installed.

A still further object of the invention is to provide a smoke detector that adjusts itself for differences in sensitivity due to differences between a replaceable canopy that has been in service in the smoke detector and a replacement canopy that is either new, cleaned, or has not been in service on that smoke detector.

Yet another object of the invention is to provide a self-contained smoke detector that guards against false alarms but rapidly signals alarm conditions.

One aspect of the present invention is a self-contained smoke detector that has such internal self-diagnostic and self-adjustment capabilities. The smoke detector includes a smoke sensing element, e.g., the LED-photodiode combination used in the smoke detector described in the '074 patent. It also includes a sampler that samples the output of the smoke sensing element to produce a succession of samples indicative of the smoke level at a respective one of plural sampling times. The output of the sampler leads to an alarm control circuit, e.g., a microprocessor. The smoke sensing element and the alarm control circuit are mounted in a discrete housing.

There is a direct correlation between a change in the output of the smoke sensing element over a time interval longer than the smoldering time of a slow fire and the sensitivity of that sensor. Thus, by determining such changes in the sensor output, the smoke detector can determine when it has become either under-sensitive or over-sensitive. In a preferred embodiment, the determination of under-or lower-sensitivity is based on the amount of change in sensor output voltage measured in clean air. The smoke detector samples the amount of smoke present by periodically energizing the LED and then determining the smoke obscuration level. An algorithm implemented in software stored in memory determines whether for a time (such as 24 hours) the clean air voltage is outside established sensitivity tolerance limits. The microprocessor makes appropriate adjustments to counteract changes in sensitivity by carrying out an algorithm defined by instructions stored in firmware. The algorithm determines a floating adjustment and uses it to adjust the raw data provided by the smoke sensing element. The microprocessor compares the data so adjusted with an alarm threshold stored in memory and indicates an excessive level of smoke if the adjusted data exceeds the alarm threshold. The microprocessor then determines whether to signal an alarm condition.

Another aspect of the invention is a method of operating a smoke detector. The method includes producing signal samples indicative of measurements of a smoke level in a spatial region; the samples include a present sample and plural preceding samples. An alarm threshold is established, preferably in a calibration phase. An adjustment is determined based on selected samples. The present sample, the alarm threshold, and the adjustment are used to determine whether the present sample indicates an excessive level of smoke. It is then determined whether to produce an alarm signal.

Additional objects and advantages of the present invention will be apparent from the following detailed description of a preferred embodiment thereof, which proceeds with reference to the accompanying drawings.

BRIEF DESCRIPTION OF THE DRAWINGS

FIGS. 5-1 through 5-4 are more detailed versions of the flow diagram of FIG. 4.

DETAILED DESCRIPTION OF A PREFERRED EMBODIMENT

Figure 1:
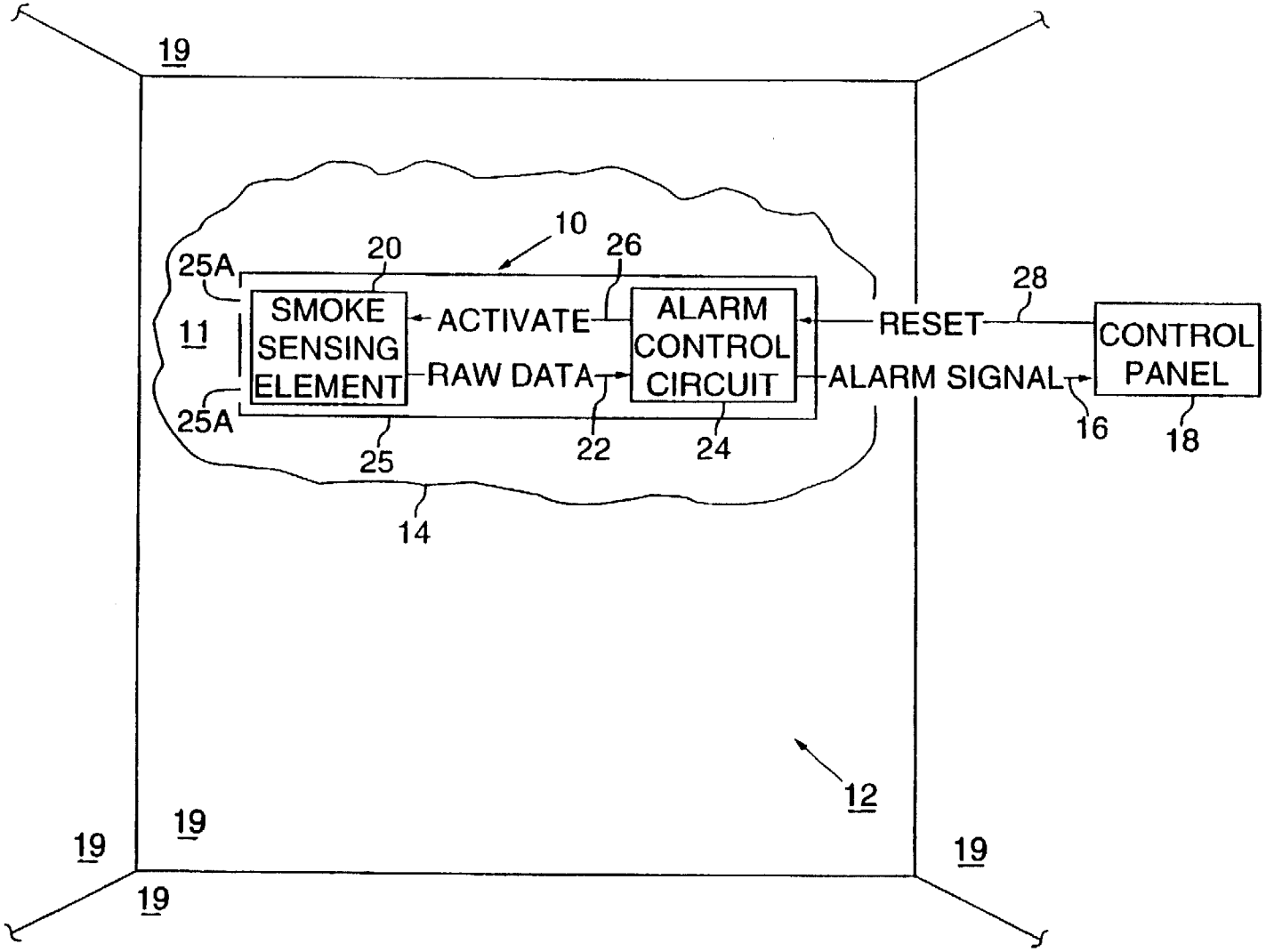
FIG. 1 is a schematic block diagram showing a smoke detector according to the invention connected to a control panel.

With reference to FIG. 1, a self-contained smoke detector 10 is used to determine whether at a spot 11 in a confined spatial region 12 being monitored there is a sufficiently high level of smoke (e.g., in ambient air at spot 11) that an alarm condition should be signaled by producing an alarm signal on a signal path 16 to a control unit or panel 18. Region 12 may but need not be at least partly confined by surfaces 19. Smoke detector 10 includes a smoke sensing element 20 that measures the smoke level at spot 11 and provides over signal path 22 to an alarm control circuit 24 a sensing element signal or raw data, i.e., data that have not yet been adjusted as described below, indicative of that smoke level. Smoke sensing element 20 and alarm control circuit 24 are each mounted on a discrete housing 25 that operatively couples smoke sensing element 20 to region 12 and that mounts smoke sensing element 20 and alarm control circuit 24 at spot 11. Housing 25 may, but need not, incorporate a replaceable canopy, e.g., the replaceable canopy of the smoke detector described in the '074 patent. Housing 25 may have openings 25A that admit ambient air 14 with any associated smoke for measurement by smoke sensing element 20. Smoke sensing element 20 is, e.g., an LED-photodiode scattering sensor that detects light scattered from smoke particles (the "scattering implementation") as described in the '074 patent. Alarm control circuit 24 controls activation of smoke sensing element 20 over signal path 26. Control panel 18 resets alarm control circuit 24 over signal path 28.

Figure 2:
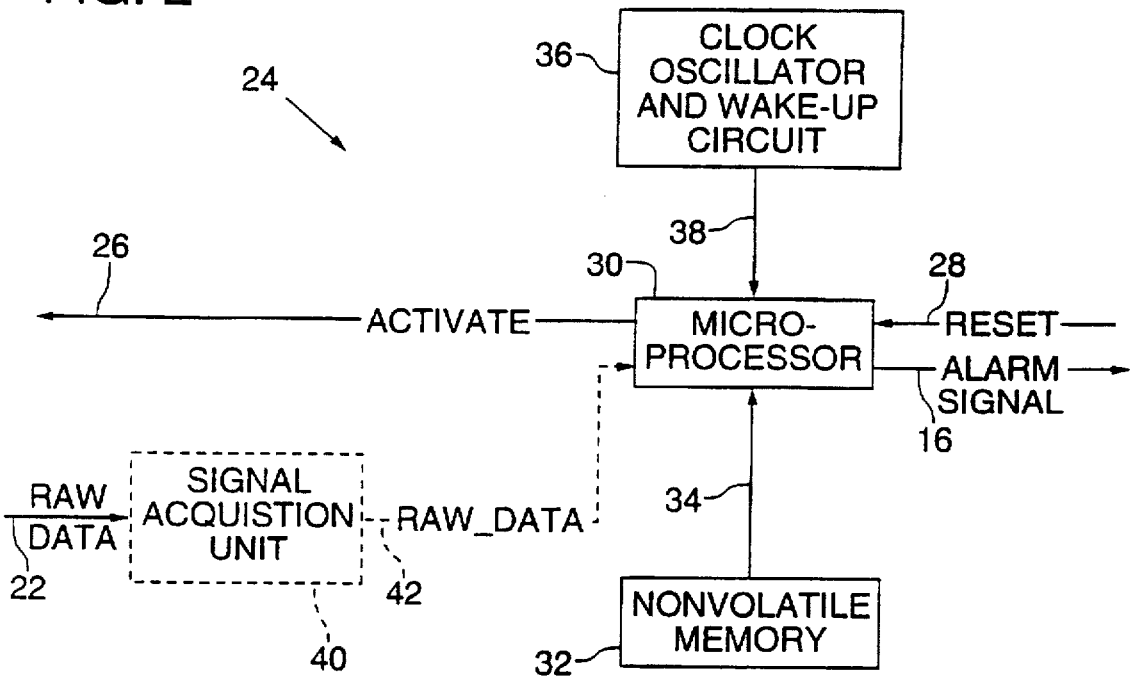
FIG. 2 is a schematic block diagram of an alarm control circuit shown in FIG. 1.

FIG. 2 is a schematic block diagram showing details of alarm control circuit 24. Circuit 24 includes a processor or microprocessor 30, to which are connected a nonvolatile memory 32, e.g., an electrically erasable programmable read-only memory, over signal path 34 and a clock oscillator and wake-up circuit 36 over signal path 38. An instruction set for microprocessor 30 is contained in read-only memory internal to microprocessor 30. Memory 32 holds certain operating parameters described below that are determined during calibration. Raw data from smoke sensing element 20 may lead over signal path 22 to an optional signal acquisition unit 40, which converts or conditions the raw data, which are, e.g., analog data, into a digital form RAW_DATA and then conveys that digital form over signal path 42 to microprocessor 30. In the scattering implementation, signal acquisition unit 40 includes an analog-to-digital ("A/D") converter, described below with reference to FIGS. 6 and 7, to convert the analog output of the photodiode to digital form. If smoke sensing element 20 produces its raw data output in a form, whether analog or digital, that microprocessor 30 can receive directly, then signal path 22 may convey that raw data directly to the microprocessor, which produces from that raw data the digital representation RAW_DATA on which it operates.

To reduce the power requirements of smoke detector 10, microprocessor 30 is preferably inactive or "asleep" except when it is periodically "awakened." Clock oscillator and wake-up circuit 36 may, depending on the microprocessor selected, be internal or external to microprocessor 30. Also to reduce power requirements, microprocessor 30 activates smoke sensing element 20 over signal path 26 to sample the smoke level in region 12 (FIG. 1). However, any form of sampling that produces samples of the output of smoke sensing element 20 at appropriate times is adequate. The sampling produces successive samples, each indicative of a smoke level at a respective one of successive sampling times. Microprocessor 30 is reset over line 28 by control panel 18 (FIG. 1).

Figure 3:
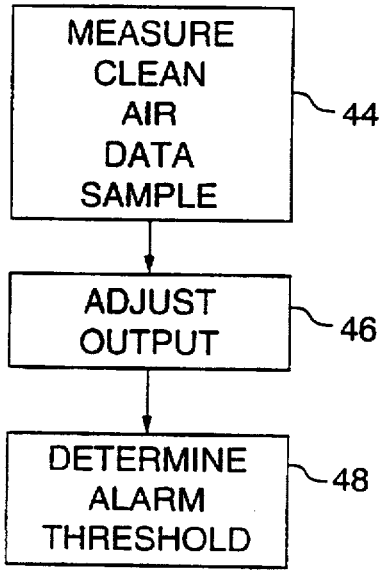
FIG. 3 is a flow diagram showing steps performed in the factory during calibration of the smoke detector.

The self-adjustment and self-diagnostic capabilities of smoke detector 10 depend on calibrating the sensor electronics and storing certain parameters in memory 32. FIG. 3 is a flow diagram showing the calibration steps performed in the factory. Process block 44 indicates the measurement in an environment known to be free of smoke of a clean air signal or clean air data sample CLEAN_AIR that represents a 0 percent smoke level. In the scattering implementation, the clean air voltage of the photodiode is about 0.6 volt, which typically is converted to a digital word equivalent to decimal 120. Upper and lower tolerance limits, used in self-diagnosis, are set at ±42 percent of CLEAN_AIR.

Process block 46 indicates the adjustment of the output of smoke sensing element 20 and any signal acquisition unit 40. This is accomplished by placing smoke sensing element 20 in a chamber that presents a simulated smoke environment representing a calibrated level of smoke. Because the calibrated level of smoke in such an environment is constant, smoke sensing element 20 produces a constant output; parameters of smoke detector 10 are adjusted to bring that output to a calibrated value. In the scattering implementation, the gain of the A/D converter is adjusted as described below with reference to FIGS. 6 and 7 so that smoke sensing element 20, in that simulated smoke environment, and signal acquisition unit 40 reach an alarm voltage threshold (typically about 2.0 volts) that typically is converted to a digital word equivalent to about decimal 230–235, for a smoke obscuration level of 3.1 percent per foot.

Process block 48 indicates the determination of an alarm threshold that corresponds to an output of smoke sensing element 20 that indicates the presence of excessive smoke in region 12 and in response to which an alarm condition should be signaled. In the scattering implementation, the alarm threshold is the threshold to which the gain is calibrated (process block 46).

Upon conclusion of the calibration process, the output of smoke sensing element 20 and any signal acquisition unit 40 is calibrated, and values for CLEAN_AIR, the upper and lower tolerance limits, and the alarm threshold are stored in memory 32. Each of those values is specific to the individual smoke detector 10 that was calibrated. Also stored in memory 32 are values for a slew limit, ADJISENS, and ADJSENS, the use of which is described below.

The self-adjustment and self-diagnostic features of the invention as implemented in the algorithm described in connection with FIGS. 4 and 5 rest on the existence in smoke sensing element 20 of a linear relationship between the output of that sensor and the level of smoke. That relationship can be expressed as $$y=m*x+b,$$

is where y represents the sensor output, m represents the gain (defined for a scattering sensor as the change in sensor output per percent obscuration per foot), and b represents the clean air output. In the scattering implementation, the gain is unaffected by a build-up of dust or other contaminants. Any smoke sensing element in which the gain is unaffected by factors that cause a sensitivity change may be used as smoke sensing element 20 with the algorithm of FIGS. 4 and 5.

A change in sensitivity causes smoke sensing element 20 to produce, in conditions in which smoke indicative of an alarm condition is not present ("non-alarm conditions"), an output different from CLEAN_AIR. Whenever the output of smoke sensing element 20 in such conditions rises, smoke detector 10 becomes more sensitive in that it will produce an alarm signal at a smoke level that is less than the alarm threshold. This may produce false alarms. Conversely, whenever the output of smoke sensing element 20 in such conditions falls below the clean air voltage measured at calibration, smoke detector 10 becomes less sensitive in that it will not produce an alarm signal until the smoke level exceeds the level to which the alarm threshold was set. This can cause delay in, or nonproduction of, the alarm signal.

Because the gain is constant even with changes over time in the output in non-alarm conditions, there is a direct correlation between a change in output voltage in non-alarm conditions and a change in sensitivity. The invention exploits that correlation by using certain changes over time in the output of smoke sensing element 20 as a basis for adjusting for change of sensitivity to maintain smoke detector 10 with the sensitivity with which it was calibrated.

The self-adjustment process that microprocessor 30 executes is designed to correct, within certain limits, for changes in sensitivity of smoke detector 10 while retaining the effectiveness of smoke detector 10 for detecting fires. The self-adjustment process rests on the fact that a change in the output of smoke sensing element 20 over a data gathering time interval that is long in comparison to the smoldering time of a slow fire in region 12 usually results from, not a fire, but a change in sensitivity of the system. Microprocessor 30 uses such a change as a basis for determining a floating adjustment FLT_ADJ that is used to adjust the unadjusted or raw output or digital word RAW_DATA to produce an adjusted data value ADJ_DATA that is typically closer to CLEAN _AIR than is the RAW_DATA reading. ADJ_DATA is then used for the alarm test and for self-diagnosis. FLT_ADJ is positive or negative when smoke detector 10 has become less sensitive or more sensitive, respectively, than it was at calibration.

Figure 4:
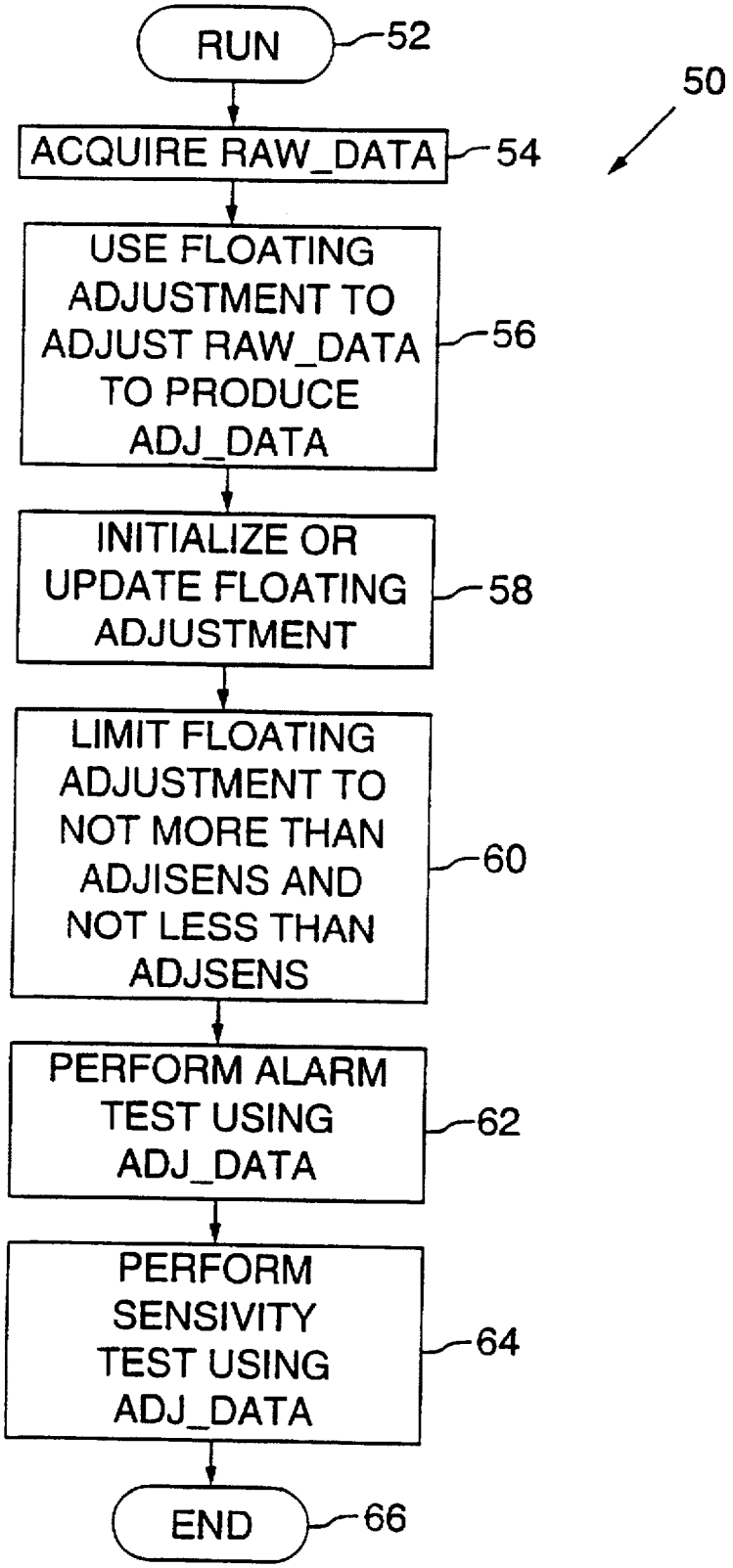
FIG. 4 is a flow diagram summarizing steps executed by a microprocessor shown in FIG. 2 in performing self-adjustment, determining whether an alarm condition exists, and carrying out self-diagnosis.
Figures 1, 5:
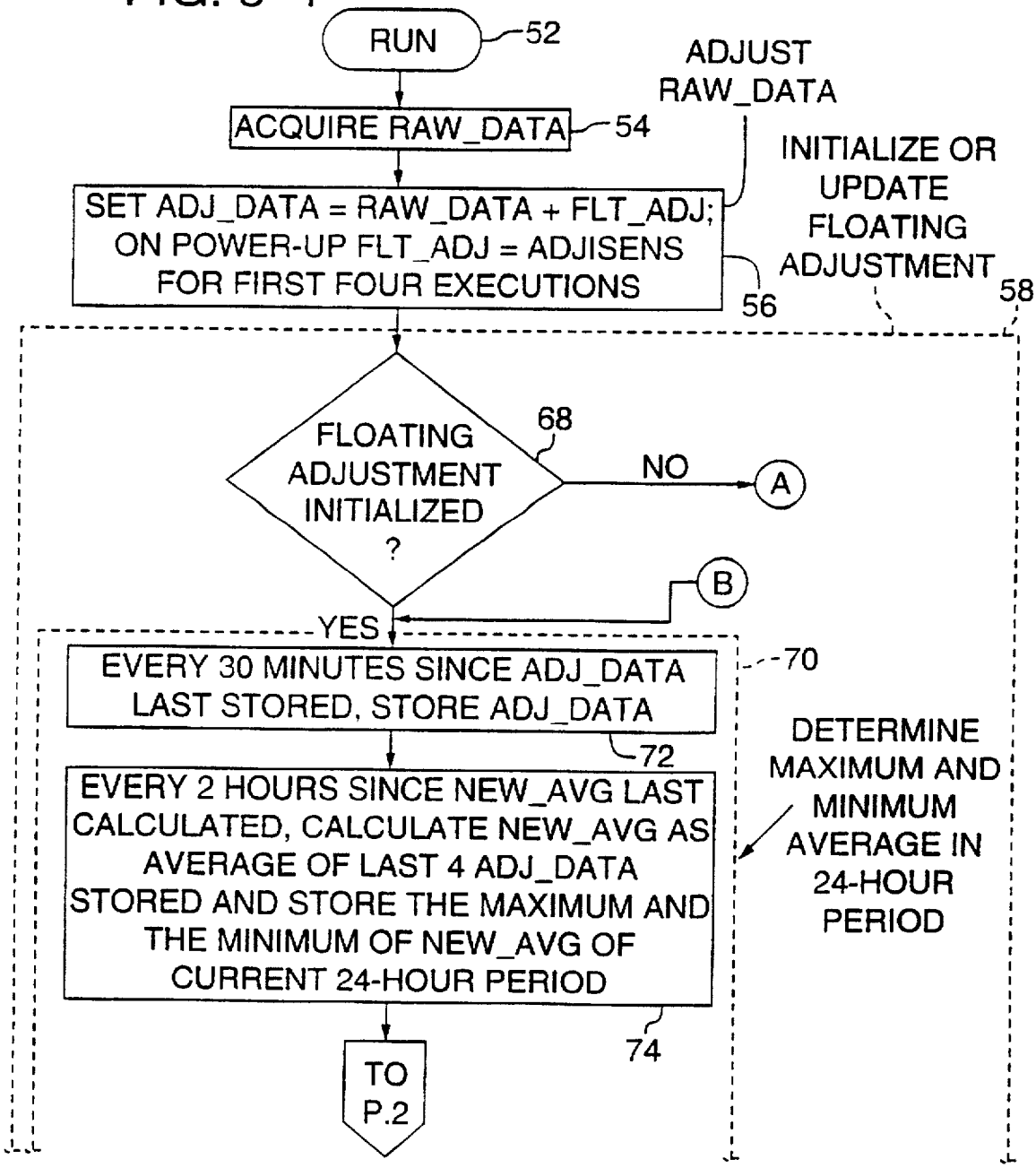
Figures 2, 5:
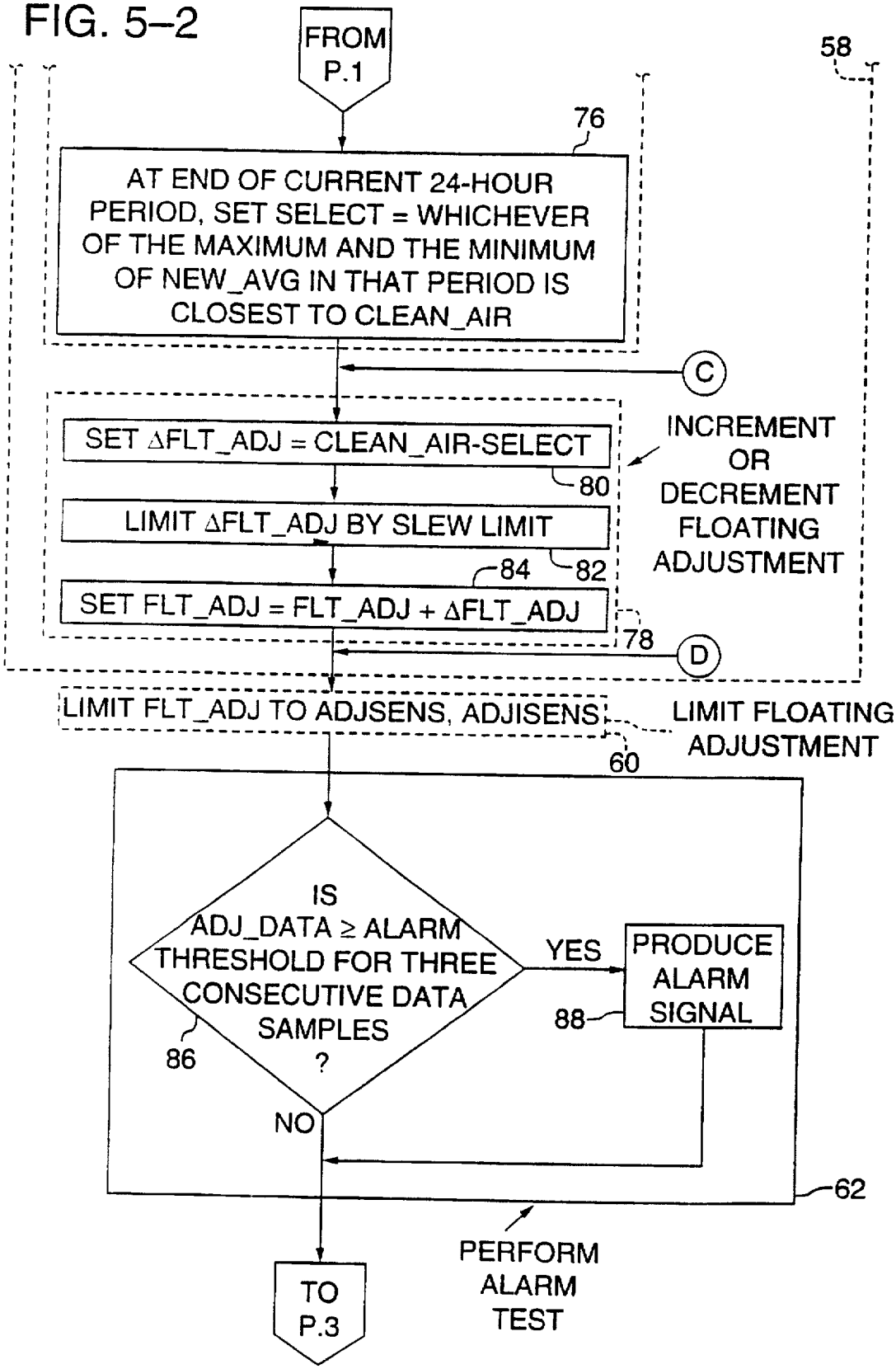
Figures 3, 5:
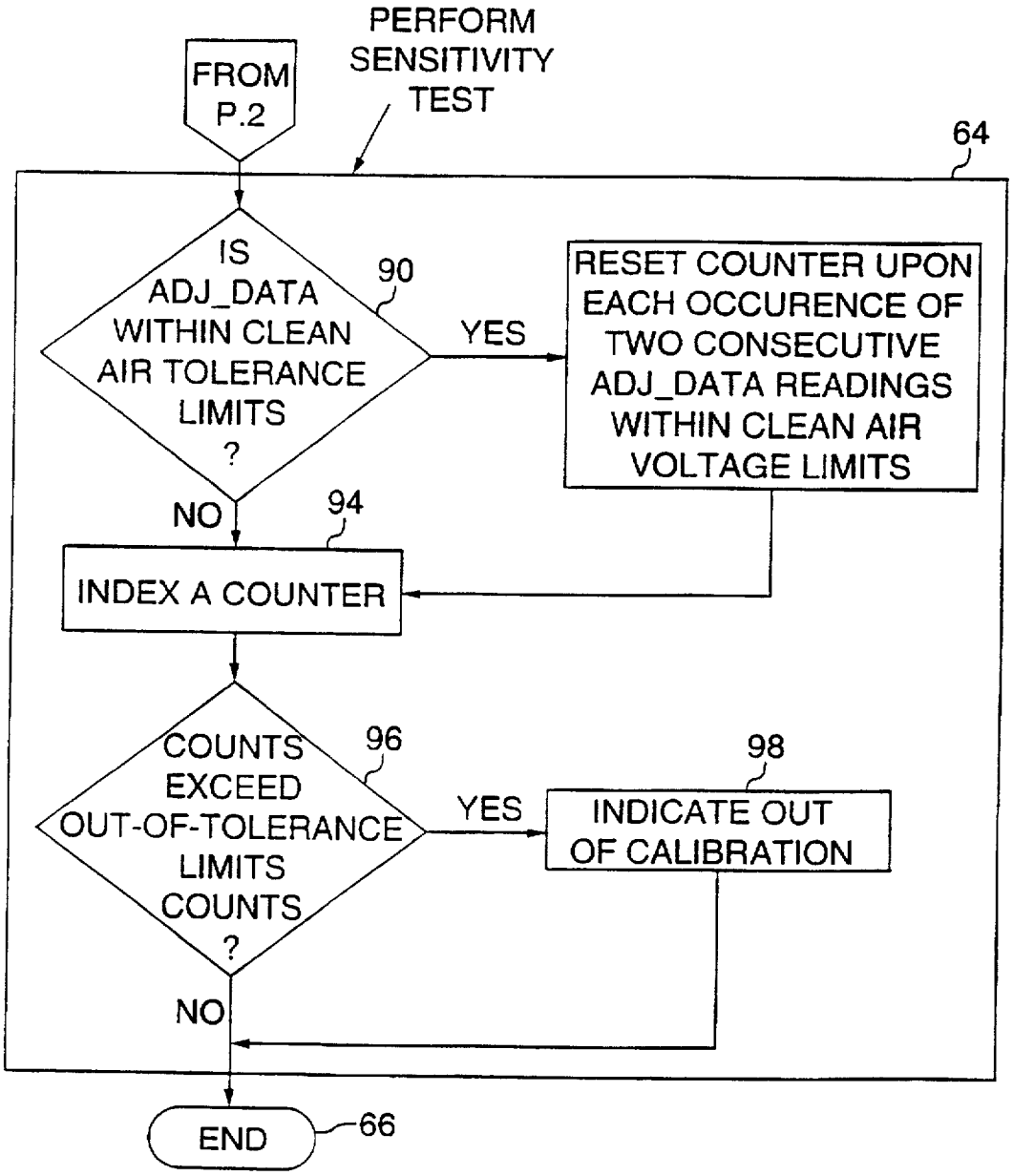
Figures 4, 5:
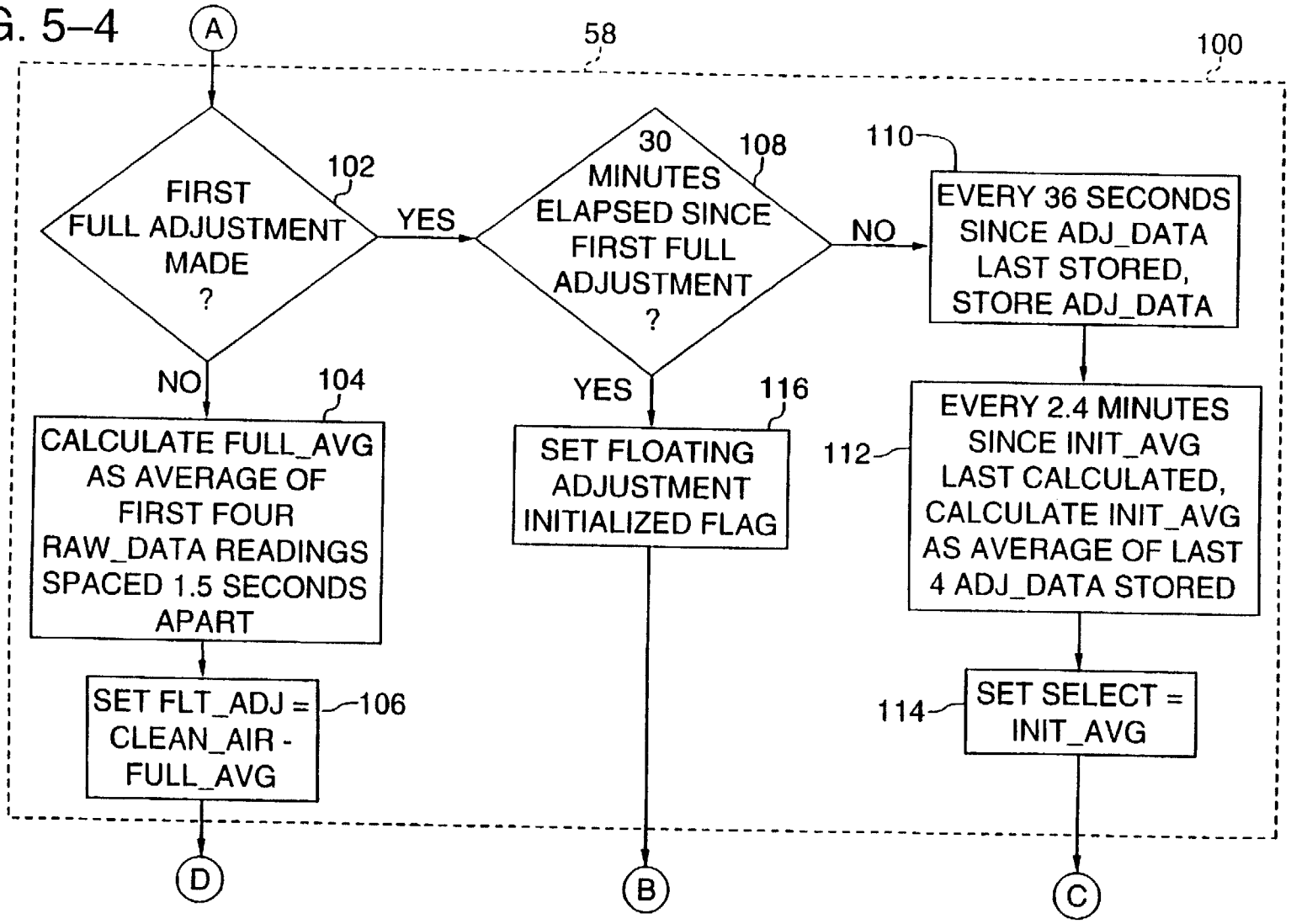

FIGS. 4 and 5 are flow diagrams showing an algorithm or routine 50 implemented in microprocessor 30 to carry out the self-adjustment, alarm test, and self-diagnosis features of the invention. Microprocessor 30 receives the successive signal samples produced by smoke sensing element 20 and uses those samples for three purposes.

First, microprocessor 30 determines successive floating adjustments or values of FLT_ADJ with use of the sensing element signal or RAW_DATA produced during a corresponding one of successive data gathering time intervals or 24-hour periods (FIGS. 4 and 5, process blocks 58, 60). Each data gathering time interval extends a data gathering duration or 24 hours. Each floating adjustment is indicative at least in part of relationships between RAW_DATA in the 24-hour period and CLEAN_AIR. Typically the value of FLT_ADJ, or at least the trend from one value of FLT_ADJ to the next succeeding value, is generally indicative of whether RAW_DATA is higher or lower than CLEAN_AIR in the corresponding 24-hour period. In the preferred embodiment FLT_ADJ is (after initialization) updated once every 24 hours on the basis of selected samples produced in those 24 hours.

Second, microprocessor 30 determines, at successive smoke level determination times (FIGS. 4 and 5, process blocks 56 and 62) whether the output of sensing element 20 or RAW_DATA indicates an excessive level of smoke at spot 11 in region 12. It does so with use of an alarm threshold, the sensing element signal, and one of the floating adjustments that corresponds to the smoke level determination time. The corresponding one of the floating adjustments used has as its data gathering time interval one that is sufficiently recent to the smoke level determination time that the sensing element signal in the absence of smoke is unlikely to have changed significantly from the data gathering time interval to that smoke level determination time. In the preferred embodiment the value of FLT_ADJ is typically used in the 24-hour period immediately succeeding the 24-hour period that is the typical data gathering time interval for that value of FLT_ADJ. Thus, the data gathering time for that value of FLT_ADJ is within 48 hours before that value of FLT_ADJ is used. During such a 48-hour time span, it is unlikely that the response of sensing element 20 in the absence of smoke would change significantly in typical regions 12. In principle, a value of FLT_ADJ that was produced on the basis of a data gathering time interval much more than 48 hours before (even a year before) that value of FLT_ADJ is used at a smoke level determination time could produce acceptable results for some regions 12. Whether a data gathering time interval is sufficiently recent to a smoke level determination time for a floating adjustment determined on the basis of that data gathering time interval to be used at that smoke level determination time depends on, e.g., the rapidity of significant change in the sensing element signal in the absence of smoke and the desired degree of fidelity of FLT_ADJ at that smoke level determination time.

Third, microprocessor 30 determines, with use of a determination of an excessive level of smoke, whether to signal the existence of an alarm condition by activating its alarm signal over line 16. Microprocessor 30 activates its alarm signal only when it has determined that ADJ_DATA exceeds the alarm threshold for a predetermined time or for a predetermined number of or three consecutive signal samples. Such confirmation of an alarm condition provides a major advantage over conventional smoke detectors and smoke detector systems. Every false alarm places firefighters' lives at risk in traveling to the scene of the false alarm, decreases firefighters' ability to respond to genuine alarms, and imposes unnecessary costs. The choice of the predetermined time or of the predetermined number of consecutive signal samples entails balancing the need for prompt signaling of a true alarm condition against the need to avoid false alarms.

For conciseness, FIGS. 4 and 5 show (in solid outline) certain processes or decisions that microprocessor 30 performs in each execution of routine 50 and (in broken outline) other processes or decisions that it performs only in selected executions.

With reference to FIG. 4, microprocessor 30 executes routine 50 once every 9 seconds (except at power-up or reset, when it executes routine 50 once every 1.5 seconds for the first four executions), entering those steps at RUN block 52.

As the first step, indicated by process block 54, microprocessor 30 acquires as a digital word RAW_DATA a sensing element signal or voltage from smoke sensing element 20 or signal acquisition unit 40. Microprocessor 30 then uses a value currently assigned to FLT_ADJ to adjust RAW_DATA to produce the adjusted data value ADJ_DATA, as indicated by process block 56.

The next two process blocks, 58 and 60, indicate processes that microprocessor 30 performs only at selected times indicated in greater detail in connection with FIG. 5. To conserve code in a practical implementation, conditions controlling entry into process block 58 may be tested even in executions of routine 50 in which such processes are not to be carried out, and process block 60 may be carried out in each execution of routine 50 even though it has the potential to affect the value of FLT_ADJ only in executions in which FLT_ADJ is changed. Process block 58 indicates that microprocessor 30 initializes or updates FLT_ADJ. Process block 60 indicates that microprocessor 30 then limits the maximum value of FLT_ADJ to not greater than a predetermined upper limit ADJISENS and limits the minimum value of FLT_ADJ to not less than a predetermined lower limit ADJSENS. ADJISENS and ADJSENS limit the extent to which smoke detector 10 will self-correct for, respectively, insensitivity and oversensitivity, before indicating that it requires service. ADJISENS and ADJSENS are chosen in conjunction with the tolerance limits so that a self-diagnostic feature described below will signal a need for maintenance while smoke detector 10 is still operable to detect fires reliably. In the scattering implementation ADJISENS corresponds to a change in smoke obscuration level of about 0.5 percent per foot or about decimal 18 in the digital word FLT_ADJ, and ADJSENS corresponds to a change in smoke obscuration level of about 1.0 percent per foot or about decimal 35 in that digital word. ADJISENS is set so that smoke detector 10 does not automatically produce an alarm signal at power-up or reset in the initialization process described below.

As indicated by process block 62, microprocessor 30 then performs an alarm test using ADJ_DATA. Specifically, microprocessor 30 compares ADJ_DATA with the alarm threshold value established during calibration and stored in memory 32 and activates the alarm signal when ADJ_DATA equals or exceeds the alarm threshold value for three consecutive signal samples or as described above. Then, as indicated by process block 64, microprocessor 30 uses ADJ_DATA to perform a self-diagnostic sensitivity test to determine whether to signal that smoke detector 10 is sufficiently out of adjustment to require service. When that task is complete, microprocessor 30 ends that execution of routine 50, as indicated by END block 66.

FIG. 5 shows further detail of certain parts of routine 50. The process of adjusting RAW_DATA (process block 56) includes setting ADJ_DATA equal to RAW_DATA plus FLT_ADJ during each execution of routine 50 except on power-up or reset of microprocessor 30. On power-up or reset FLT_ADJ is set equal to ADJISENS for the next four executions of routine 50. That adjustment ensures that even a very insensitive smoke detector 10 is properly responsive to smoke conditions on power-up or reset; for a smoke detector 10 that is less insensitive, FLT_ADJ is rapidly initialized as described below.

The process of initializing or updating FLT_ADJ (process block 58) includes determining whether FLT_ADJ has been initialized (decision block 68). If not so, as is the case at power-up or reset, control passes via connector A to steps discussed below in connection with process block 100 (FIG. 5, sheet 4). If so, control passes to process block 70, which indicates that microprocessor 30 proceeds to determine the maximum and the minimum of certain averages of FLT_ADJ taken in a preceding base time interval or period having a preferred base time duration of 24 hours.

Within process block 70, process block 72 indicates that ADJ_DATA is stored every 30 minutes since it was last stored. Process block 74 indicates that, every two hours since a trial average NEW_AVG was last calculated, microprocessor 30 uses the last four stored values of ADJ_DATA to calculate NEW_AVG as the average of those last four samples. Each value of NEW_AVG is thus based on a respective one of plural non-identical subsets of the ADJ_DATA samples produced within a respective one of plural adjustment time intervals having a predetermined adjustment time duration.

Process block 74 also indicates that microprocessor 30 stores the maximum and the minimum of the values of NEW_AVG determined during a current 24-hour base time interval. Process block 76 indicates that at the end of that 24-hour base time interval microprocessor 30 assigns to a variable SELECT (used in process block 78) whichever of the maximum and the minimum of NEW_AVG in that 24-hour period is closest to CLEAN_AIR. The use of the one of the maximum and the minimum of the averages that is closest to CLEAN_AIR reduces the influence of transient events by filtering from the determination of FLT_ADJ at least some samples that may indicate an aberrant level of smoke in region 12; it also reduces the change made in FLT_ADJ at each adjustment. Because SELECT is calculated only once every 24 hours after initialization of smoke detector 10, FLT_ADJ is changed only once every 24 hours. Making any change in FLT_ADJ (after it has been initialized) on the basis of data collected over a base time interval that is long in comparison to the smoldering time of slow fires that could occur in region 12 helps to ensure that smoke detector 10 will accurately detect alarm conditions.

The process of updating, i.e., incrementing or decrementing, FLT_ADJ (process block 78) limits the magnitude of any change in FLT_ADJ at the end of each 24-hour base time interval or period to equal to or less than a predetermined slew limit, which further reduces the change made in FLT_ADJ at each update. The relationship of the slew limit to the values chosen for the adjustment limits ADJISENS and ADJSENS determines the maximum number of days needed for smoke detector 10 to reach either of those adjustment limits. In the scattering implementation the slew limit corresponds to a change of 0.1 percent per foot in smoke obscuration level, e.g., to a change of approximately decimal 3 in the digital word FLT_ADJ. A variable AFLT_ADJ is set equal to CLEAN_AIR—SELECT (process block 80) and then limited in magnitude to the slew limit (process block 82). FLT_ADJ is then updated by being set equal to the previous value of FLT_ADJ plus ΔFLT_

ADJ (process block 84). Process blocks 82 and 84 ensure that each value of FLT_ADJ is (with the exception of the value ADJISENS assigned to FLT_ADJ on power-up or reset) within the slew limit of the immediately preceding value of FLT_ADJ.

The process of performing the alarm test (process block 62) includes determining whether ADJ_DATA equals or exceeds the alarm threshold (decision block 86). Each execution of routine 50 thus defines a smoke level determination time. Microprocessor 30 produces its alarm signal announcing the presence of an alarm condition, as indicated by process block 88, only when ADJ_DATA equals or exceeds the alarm threshold for three consecutive signal samples, as described above.

The process of performing the sensitivity test (process block 64) is as follows. Decision block 90 indicates the sequential comparison by microprocessor 30 of ADJ_DATA against the upper and lower tolerance limits and the determination by microprocessor 30 of whether ADJ_DATA falls within those limits. If so, smoke detector 10 continues and, as indicated by process block 92, a counter in microprocessor 30 and having a 2-count modulus monitors the occurrence of two consecutive ADJ_DATA amounts that fall within the tolerance limits. If not so, a counter is indexed by one count, as indicated by process block 94. However, each time two consecutive ADJ_DATA amounts within the tolerance limits appear, the 2-count modulus counter resets the counter of process block 94.

Decision block 96 represents a determination of whether the number of counts accumulated in the counter of process block 94 exceeds a number limit corresponding to consecutive ADJ_DATA values in out-of-tolerance limit conditions for each of the executions of routine 50 in a predetermined time interval (e.g., 24 hours). If so, microprocessor 30 provides an indicator (not shown), e.g., a blinking LED visible from outside smoke detector 10, as indicated in process block 98. Other indicators, e.g., an audible alarm or a relay output, may be used. The indicator indicates that smoke detector 10 has drifted out of calibration to become either under- or over-sensitive and needs to be attended to. If not, microprocessor 30 ends its current execution of routine 50.

The sensitivity test algorithm provides a rolling out-of-tolerance measurement period that is restarted whenever there are two consecutive appearances of ADJ_DATA within the tolerance limits. Smoke detector 10 thus monitors its own sensitivity status without a need for manual evaluation. Use of ADJ_DATA rather than RAW_DATA in the sensitivity test extends the time before smoke detector 10 signals that it is out of calibration and thus extends the service life of smoke detector 10 and/or reduces costs of maintaining or servicing it.

With reference to sheet 1 of FIG. 5, if FLT_ADJ is not initialized when routine 50 is entered, decision block 68 directs control via connector A to process block 100 (FIG. 5, sheet 4), which controls initialization of FLT_ADJ. FLT_ADJ is initialized for two reasons: (1) to establish at installation an initial base value for FLT_ADJ in the environment in which smoke detector 10 is installed, and (2) to allow smoke detector 10 to reestablish a base value for FLT_ADJ after a reset of microprocessor 30 in a commercial implementation that lacks nonvolatile memory for storing the value of FLT_ADJ through a reset.

Initialization has two phases, represented by the two directions of process flow from decision block 102, which indicates that microprocessor 30 determines whether a first full adjustment has occurred following the most recent power-up or reset. The first phase makes a full adjustment of FLT_ADJ, i.e., an adjustment that is not limited in magnitude by the slew limit. Process block 104 represents calculation of a variable FULL_AVG as the average of RAW_DATA readings taken in the first four executions of routine 50 after power-up or reset, which are spaced 1.5 seconds apart. This quickly establishes an average value FULL_AVG of the response of smoke sensing element 20 and any signal acquisition unit 40 to ambient conditions in region 12. Process block 106 indicates that, to bring smoke detector 10 back to the response to which it was set during calibration, FLT_ADJ is then set equal to CLEAN_AIR—FULL_AVG. (This occurs on the fifth execution of routine 50 after power-up or reset; FLT_ADJ is set at ADJISENS for the first four executions of routine 50 after power-up or reset (process block 56 (FIG. 5, sheet 1).) That step is not limited by the slew limit; thus, after process block 106, control passes via connector D to process block 60 (FIG. 5, sheet 2).

On the next execution of routine 50, decision block 102 passes control to the second phase of initialization, which allows for correction of the first full adjustment, which could have been affected by a transient smoke event. Decision block 108 establishes a 30-minute interval after the first full adjustment; until that 30-minute interval elapses, decision block 108 passes control to process block 110.

Process block 110 indicates that, within the 30-minute interval, microprocessor 30 stores ADJ_DATA every 36 seconds. Process block 112 indicates that every 2.4 minutes microprocessor 30 calculates the average of the last four stored values of ADJ_DATA and assigns the value of that average to a variable INIT_AVG. Process block 114 indicates that the value of INIT_AVG is assigned to the variable SELECT preliminary to entering (via connector C) process block 78 (FIG. 5, sheet 2) for limiting by the slew limit any increment or decrement of FLT_ADJ during the second phase.

Thus, during the 30-minute interval FLT_ADJ may change by the slew limit once every 2.4 minutes, i.e., as many as 20 times. This rapidly corrects FLT_ADJ for any transient smoke event that may have occurred while data was gathered for calculating FULL_AVG (process block 104).

Decision block 108 indicates that, when the 30-minute interval since the first full adjustment has elapsed, control is transferred to process block 116, which indicates that a floating adjustment initialized flag is set in microprocessor 30. After process block 116, microprocessor 30 proceeds via connector B to process block 70. On the next execution of routine 50, decision block 68 (FIG. 5, sheet 1) recognizes that the flag is set and transfers control to process block 70, thus bypassing process block 100. The flag is cleared on power-up or reset.

When microprocessor 30 produces an alarm signal over signal path 16 (FIGS. 1 and 2), control panel 18 verifies the existence of an alarm condition before producing its own alarm signal, which may be, e.g., a ringing bell, a sounding siren, or a signal to authorities such as police or firemen. Control panel 18 verifies an alarm condition by resetting microprocessor 30 by temporarily reducing the voltage of its power supply. Microprocessor 30 then executes the initialization process of routine 50, in which FLT_ADJ is set as ADJISENS for the first four executions (process block 56 (FIG. 5, sheet 1)). If microprocessor 30 then confirms the existence of an alarm condition by again producing its alarm signal over signal path 16 as described above, the alarm condition is confirmed, and control panel 18 produces its own alarm signal. Such verification of an alarm condition further reduces the risk of false alarms.

The invention makes it possible, in a smoke detector that is adapted to receive a replaceable canopy, to replace a first canopy with a second canopy that is either new, cleaned, or has not been in service on that smoke detector, even when RAW_DATA in the absence of smoke has a rather different value for the two canopies. Such a difference may result from passage of time since the first canopy was installed, e.g., from an accumulation of dust on the first canopy that is not present on the second canopy, or it may result from differences between the two canopies, e.g., when the two canopies produce a less uniform ADJ_DATA value in the absence of smoke than is produced by the design disclosed in the '074 patent.

The first replaceable canopy is installed in smoke detector 10, which is then operated as described above. Smoke detector 10 determines a value of FLT_ADJ appropriate to the first canopy and updates that value. The first canopy is then removed, e.g., when smoke detector 10 signals that it is outside a tolerance limit, and the second canopy is installed in smoke detector 10. Typically the value of RAW_DATA in the absence of smoke is different with the second canopy installed from what it was with the first canopy.

However, smoke detector 10 simply adjusts the value of FLT_ADJ to be appropriate to the second canopy. It may do so relatively quickly by being reset and thus initialized by sending the reset signal from control panel 18 after the second canopy is installed. (Such a reset and initialization could be alternatively be initiated by a manual reset button or a magnetically-actuated reed switch (neither shown) in smoke detector 10.) Or it may do so by executing routine 50 without reset or initialization and thereby adjusting FLT_ADJ to a value appropriate to the second canopy over a few or many days. Or, if replacing the first canopy with the second triggers an alarm signal over line 16, the reset and initialization triggered by control panel 18 over line 28 to confirm the existence of an alarm condition could adjust FLT_ADJ relatively quickly if the reset and initialization occur after the second canopy is installed.

To prevent short-term changes in clean air voltage that do not represent out-of-sensitivity indications, a microprocessor-based circuit 200 is implemented with the algorithm described above to perform self-diagnosis to determine whether an under- or over-sensitivity condition or an alarm condition exists by determining whether the clean air voltage is outside of predetermined tolerance limits for a preferred period (e.g., 24 hours).

Figure 6:
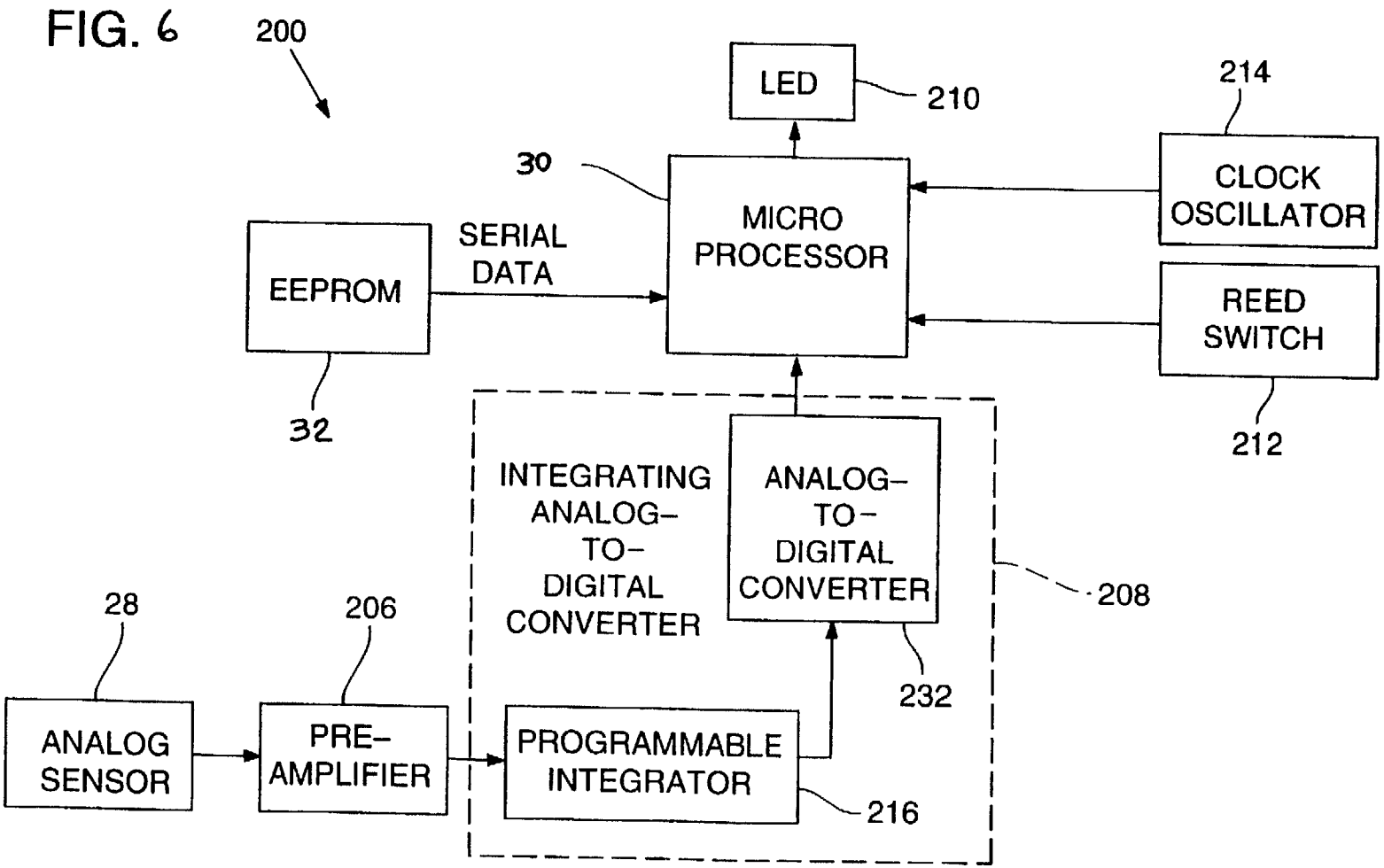
FIG. 6 is a general block diagram of the microprocessor-based circuit that implements the self-diagnostic and calibration functions of the smoke detector system.

FIG. 6 is a general block diagram of a microprocessor-based circuit 200 in which the self-diagnostic functions of the smoke detector system are implemented. The operation of circuit 200 is controlled by microprocessor 30 that periodically applies electrical power to a photodiode 28, which is a part of smoke sensing element 20, to sample the amount of smoke present. Periodic sampling of the output voltage of photodiode 28 reduces electrical power consumption. In a preferred embodiment, the output of photodiode 28 is sampled for 0.4 millisecond every nine seconds. Microprocessor 30 processes the output voltage samples of photodiode 28 in accordance with instructions stored in EEPROM 32 to determine whether an alarm condition exists or whether the optical electronics are within preassigned operational tolerances.

Each of the output voltage samples of photodiode 28 is delivered through a sensor preamplifier 206 to a variable integrating analog-to-digital converter subcircuit 208. Converter subcircuit 208 takes an output voltage sample and integrates it during an integration time interval set during the gain calibration step discussed with reference to process block 46 of FIG. 3. Upon conclusion of each integration time interval, subcircuit 208 converts to a digital value the analog voltage representative of the photo detector output voltage sample taken.

Microprocessor 30 receives and as described above adjusts the digital value, and then compares it to the alarm voltage and sensitivity tolerance limit voltages established and stored in EEPROM 32 during calibration. The process of adjusting the integrator voltages presented by subcircuit 208 is carried out by microprocessor 30 in accordance with an algorithm implemented as instructions stored in EEPROM 32. The processing steps of this algorithm have been described above with reference to FIGS. 4 and 5. Microprocessor 30 causes continuous illumination of a visible light-emitting diode (LED) 210 to indicate an alarm condition and performs a manually operated self-diagnosis test in response to an operator's activation of a reed switch 212. A clock oscillator 214, which is a part of clock oscillator and wake-up circuit 36, having a preferred output frequency of 500 kHz provides the timing standard for the overall operation of circuit 200.

Figure 7:
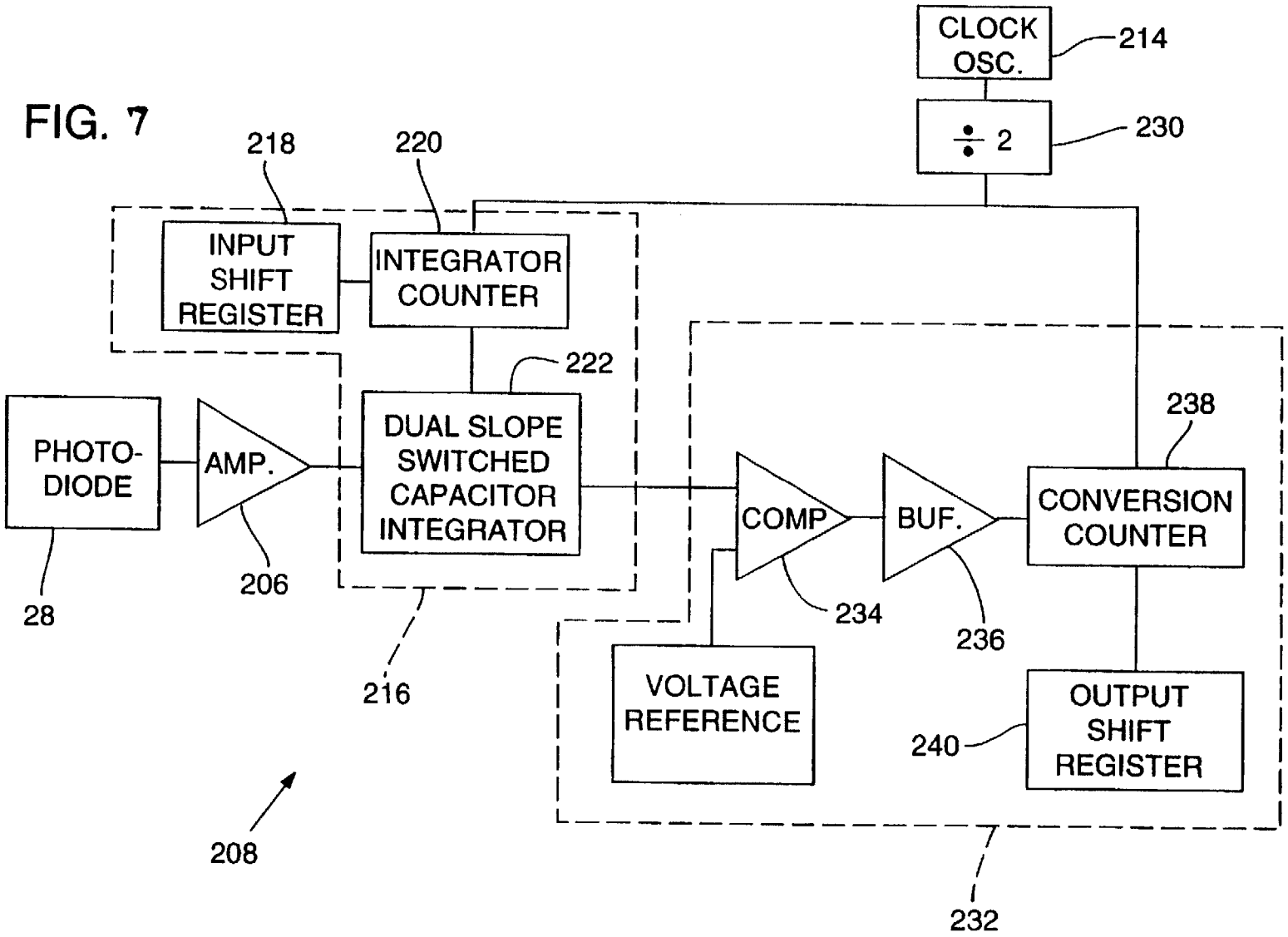
FIG. 7 is a block diagram showing in greater detail the variable integrating analog-to-digital converter shown in FIG. 6.

FIG. 7 shows in greater detail the components of variable integrating analog-to-digital converter subcircuit 208. The following is a description of operation of converter subcircuit 208 with particular focus on the processing it carries out during calibration to determine the integration time interval.

With reference to FIGS. 6 and 7, preamplifier 206 conditions the output voltage samples of photodetector 28 and delivers them to a programmable integrator 216 that includes an input shift register 218, an integrator up-counter 220, and a dual-slope switched capacitor integrator 222. During each 0.4 millisecond sampling period, an input capacitor of integrator 222 accumulates the voltage appearing across the output of preamplifier 206. Integrator 222 then transfers the sample voltage acquired by the input capacitor to an output capacitor.

At the start of each integration time interval, shift register 218 receives under control of microprocessor 30 an 8-bit serial digital word representing the integration time interval. The least significant bit corresponds to 9 millivolts, with 2.3 volts representing the full scale voltage for the 8-bit word. Shift register 218 provides as a preset to integrator up-counter 220 the complement of the integration time interval word. A 250 kHz clock produced at the output of a divide-by-two counter 230 driven by 500 kHz clock oscillator 214 causes integrator up-counter 220 to count up to zero from the complemented integration time interval word. The time during which up-counter 220 counts defines the integration time interval during which integrator 222 accumulates across an output capacitor an analog voltage representative of the photodetector output voltage sample acquired by the input capacitor. The value of the analog voltage stored across the output capacitor is determined by the output voltage of photodiode 28 and the number of counts stored in integrator counter 220.

Upon completion of the integration time interval, integrator up-counter 220 stops counting at zero. An analog-to-digital converter 232 then converts to a digital value the analog voltage stored across the output capacitor of integrator 222. Analog-to-digital converter 232 includes a comparator amplifier 234 that receives at its noninverting input the integrator voltage across the output capacitor and at its inverting input a reference voltage, which in the preferred embodiment is 300 millivolts, a system virtual ground. A comparator buffer amplifier 236 conditions the output of comparator 234 and provides a count enable signal to a conversion up-counter 238, which begins counting up after integrator up-counter 220 stops counting at zero and continues to count up as long as the count enable signal is present.

During analog to digital conversion, integrator 222 discharges the voltage across the output capacitor to a third capacitor while conversion up-counter 238 continues to count. Such counting continues until the integrator voltage across the output capacitor discharges below the +300 millivolt threshold of comparator 234, thereby causing the removal of the count enable signal. The contents of conversion up-counter 238 are then shifted to an output shift register 240, which provides to microprocessor 30 an 8-bit serial digital word representative of the integrator voltage for processing in accordance with the mode of operation of the smoke detector system. Such modes of operation include the previously described in-service self-diagnosis, calibration, and self-test.

During calibration, the smoke detector system determines the gain of the optical sensor electronics by substituting trial integration time interval words of different weighted values as presets to integrator up-counter 220 to obtain the integration time interval necessary to produce the desired alarm voltage for a known smoke obscuration level. As indicated by process block 48 of FIG. 3, a preferred desired alarm voltage of about 2.0 volts for a 3.1 percent per foot obscuration level is stored in EEPROM 32. The output of photodiode 28 is a fixed voltage when housing 25 is placed in an aerosol spray chamber that produces the 3.1 percent per foot obscuration level representing the alarm condition. Because different photodiodes 28 differ somewhat in their output voltages, determining the integration time interval that produces an integrator voltage equal to the alarm voltage sets the gain of the system. Thus, different counting time intervals for integrator up-counter 220 produce different integrator voltages stored in shift register 240.

The process of providing trial integration time intervals to shift register 218 and integrator up-counter 220 during calibration can be accomplished using a microprocessor emulator with the optical sensor electronics placed in the aerosol spray chamber. Gain calibration is complete upon determination of an integration time interval word that produces in shift register 240 an 8-bit digital word corresponding to the alarm voltage. The integration time interval word is stored in EEPROM 32 as the gain factor.

It will be appreciated that the slope of the integration time interval changes during acquisition of output voltage samples for different optical sensors but that the final magnitude of the output voltage of integrator 222 is dependent upon the input voltage and integration time. The slope of the analog-to-digital conversion is, however, always the same. This is the reason why integrator 222 is designated as being of a dual-slope type.

Reed switch 212 is directly connected to microprocessor 30 to provide a self-test capability that together with the internal design of housing 25 permits on-site verification of an absence of an unserviceable hardware fault. To initiate a self-test, an operator holds a magnet near housing 10 to close reed switch 212. Closing reed switch 212 activates a self-test program stored in EEPROM 32. The self-test program causes microprocessor 30 to apply a voltage to photodiode 28, read the integrator voltage stored in output shift register 240, and compare it to the clean air voltage and its upper and lower tolerance limits. The self-test program then causes microprocessor 30 to blink LED 210 two or three times, four to seven times, or eight or nine times if the optical sensor electronics are under-sensitive, within the sensitivity tolerance limits, or over-sensitive, respectively. If none of the above conditions is met, LED 210 blinks one time to indicate an unserviceable hardware fault.

Many changes may be made to the details of the above-described preferred embodiment of the present invention without departing from the underlying principles thereof. Microprocessor 30 could use FLT_ADJ to modify the alarm threshold and the upper and lower sensitivity thresholds. The floating adjustments could be determined by averaging the output of smoke sensing element 20 over the corresponding data gathering time intervals. Alarm control circuit 24 may employ analog rather than digital acquisition of the output of smoke sensing element 20. An example of analog acquisition is accumulation of voltage across a capacitor. Analog acquisition is typically less preferred than digital acquisition because of its usually slower response time and lesser flexibility. Alarm control circuit 24 also may acquire values of the output of smoke sensing element 20 continuously rather than by sampling. Continuous data acquisition is typically less preferred than sampling because of its usually greater power requirements. Smoke sensing element 20 may use as a radiation source a source of particles rather than of electromagnetic radiation, or it may detect smoke by detecting the presence of ions associated with smoke. When smoke sensing unit 20 is an ion detector, it need not be enclosed by housing 25. The scope of the present invention should, therefore, be determined only by the following claims.

We claim:

1. A self-contained, self-adjusting smoke detector that communicates with a central controller, comprising:

a smoke sensing element operable to produce a sensing element signal indicative of a smoke level in a spatial region, the smoke sensing element producing a clean air reference signal that represents a clean air smoke level in the spatial region;

a discrete housing that mounts the sensing element, has openings through which smoke particles flow from the spatial region to the smoke sensing element, and has interior surfaces, the interior surfaces being susceptible to dust accumulation that causes undersensitivity of the smoke sensing element to smoke particle flow;

an autonomous, self-adjusting alarm control circuit for determining an excessive level of smoke that indicates an alarm condition, the alarm control circuit determining successive floating adjustments from the clean air reference signal and from smoke level data acquired at different data acquisition times from the sensing element signal, each successive floating adjustment being determined by comparing over a data gathering time interval differences between multiple, time displaced smoke level data acquired from the sensing element signal and the clean air reference signal and calculating an offset value corresponding to the difference determined, the data gathering time interval spanning a time that is long in comparison to the smoldering time of a slow fire in the spatial region, and each floating adjustment determined in accordance with the offset value offsetting corresponding current smoke level data to produce adjusted smoke level data, the adjusted smoke level data being compared against an alarm threshold to develop an alarm signal representative of the existence of an alarm condition when the alarm threshold is exceeded; and a signal transmitter operatively associated with the central controller and the alarm control circuit for self-initiated transmission of the alarm signal to the central controller to signal the existence of an alarm condition.

2. The smoke detector of claim 1, in which the successive floating adjustments are produced during corresponding successive data gathering time intervals, in which the comparisons of the smoke level data corresponding to the sensing element signal and the clean air reference signal are made during corresponding successive smoke level determination times, and in which the alarm control circuit comprises a processor that is operable to:

receive successive samples of the sensing element signal, the samples including samples corresponding to multiple smoke level determination times and samples produced during each of multiple data gathering time intervals, determine each successive floating adjustment at least in part from selected samples produced during the corresponding data gathering time interval, and determine at each of the multiple smoke level determination times, with use of the alarm threshold, the sample corresponding to that smoke level determination time, and the corresponding floating adjustment, whether that sample indicates an excessive level of smoke in the spatial region.

3. The smoke detector of claim 2, in which the alarm control circuit is further operable to produce samples corresponding to an alarm signal when it has determined that samples corresponding to a predetermined number of consecutive smoke level determination times are indicative of the presence of the excessive level of smoke.

4. The smoke detector of claim 2, in which the selected samples are chosen so as to filter from the determination of successive floating adjustments at least some samples that may indicate an aberrant level of smoke in the spatial region.

5. The smoke detector of claim 2, in which the processor is of a microprocessor-based type.

6. The smoke detector of claim 1, in which the smoke sensing element is of an ion detecting type.

7. The smoke detector of claim 1, in which the floating adjustment is at least one of not greater than a predetermined upper limit and not less than a predetermined lower limit.

8. The smoke detector of claim 1, in which each floating adjustment has a value that is within a predetermined slew limit of the value of an immediately preceding floating adjustment.

9. In a smoke detector including a smoke sensing element that produces a sensing element signal indicative of a smoke level in a spatial region and including a canopy having openings through which smoke particles flow and having interior surfaces that are susceptible to dust accumulation, a method of making the smoke detector operationally compatible with a replacement canopy having different operational characteristics stemming from dust accumulated on and differences in the properties of its interior surfaces, comprising:

providing a self-adjusting alarm control circuit for determining whether there exists in the spatial region an excessive level of smoke that indicates an alarm condition, the alarm control circuit determining successive floating adjustments from a clean air reference signal and from smoke level data acquired at different data acquisition times from the sensing element signal, each successive floating adjustment being determined by comparing over a data gathering time interval differences between multiple, time displaced smoke level data acquired from the sensing element signal and the clean air reference signal and calculating an offset value corresponding to the difference determined, the data gathering time interval spanning a time that is long in comparison to the smoldering time of a slow fire in the spatial region, and each floating adjustment determined in accordance with the offset value offsetting corresponding current smoke level data to produce adjusted smoke level data, the adjusted smoke level data being compared against an alarm threshold to develop an alarm signal representative of the existence of an alarm condition when the alarm threshold is exceeded.

10. The method of claim 9, in which determining whether there exists an excessive level of smoke in the spatial region comprises determining, with use of the sensing element signal, one of the two most recently produced floating adjustments, and the alarm threshold, whether the sensing element signal indicates an excessive level of smoke in the spatial region.

11. The method of claim 9, in which determining whether there exists an excessive level of smoke in the spatial region comprises determining, with use of the sensing element signal, the most recently produced floating adjustment, and the alarm threshold, whether the sensing element signal indicates an excessive level of smoke in the spatial region.

12. The method of claim 9, in which the successive floating adjustments are produced during corresponding successive data gathering time intervals, in which the comparisons of the smoke level data corresponding to the sensing element signal and the clean air reference signal are made during corresponding successive smoke level determination times, and in which determining the floating adjustment comprises:

producing successive samples of the sensing element signal, the samples including a sample corresponding to multiple smoke level determination times and samples produced during each of multiple data gathering time intervals;

determining each successive floating adjustment at least in part from selected samples produced during the corresponding data gathering time interval; and determining at each of the multiple smoke level determination times, with use of the alarm threshold, the sample corresponding to that smoke level determination time, and the corresponding floating adjustment, whether that sample indicates an excessive level of smoke in the spatial region.

13. The method of claim 12, in which determining the floating adjustment corresponding to a data gathering time interval comprises:

determining each of plural trial adjustments based on a respective one of plural non-identical subsets of selected samples produced within that time interval;

determining a maximum and a minimum of those trial adjustments; and determining that floating adjustment based on the one of the maximum and the minimum that is closest to the clean air reference signal.

14. The method of claim 13, in which the selected samples in each subset are produced within a respective one of plural adjustment time intervals, each having a predetermined adjustment time duration.

15. The method of claim 13, in which determining each trial adjustment comprises:

determining an average of the selected samples in the subset to which that trial adjustment corresponds; and using the average to determine the trial adjustment for that subset.

16. The method of claim 9, in which the floating adjustment is at least one of not greater than a predetermined upper floating adjustment limit and not less than a predetermined lower floating adjustment limit.

17. A self-contained, self-adjusting smoke detector that communicates with a central controller and has self-diagnostic capabilities, comprising:

a smoke sensing element operable to produce a sensing element signal indicative of a smoke level in a spatial region, the smoke sensing element producing a clean air reference signal that represents a clean air smoke level in the spatial region; and a processor receiving and processing the sensing element signal, the processor determining successive floating adjustments from the clean air reference signal and from smoke level data acquired at different data acquisition times from the sensing element signal, each successive floating adjustment being determined by comparing over a data gathering time interval differences between multiple, time displaced smoke level data acquired from the sensing element signal and the clean air reference signal and calculating an offset value corresponding to the difference determined, and each floating adjustment determined in accordance with the offset value offsetting corresponding current smoke level data to produce adjusted smoke level data; the processor comparing the adjusted smoke level data to multiple threshold values, one of the threshold values representing a smoke obscuration alarm level and another of the threshold values representing a tolerance limit for the smoke sensing element; and the processor determining from the adjusted smoke level data corresponding to smoke obscuration levels that exceed the alarm level and from adjusted smoke level data corresponding to smoke observation levels that exceed the tolerance limit whether the adjusted smoke level data are indicative of an alarm condition or an out-of-calibration condition of the system.

18. The smoke detector of claim 17, in which the data gathering time interval spans a time that is long in comparison to the smoldering time of a slow fire in the spatial region.

19. The smoke detector of claim 17, further comprising circuitry that produces a tolerance limit signal in response to a determination by the processor whether the adjusted smoke level data exceed the tolerance limit, the tolerance limit signal being one of an audible alarm, a relay output, or a visible light indication.

20. The smoke detector of claim 17, further comprising a self-diagnostic circuit for periodic automatic testing to determine whether the smoke detector has undergone a change in sensitivity with respect to the tolerance level and thereby indicate an out-of-calibration condition.

* * * * *